US009275808B2

(12) United States Patent
Reid et al.

(10) Patent No.: US 9,275,808 B2
(45) Date of Patent: Mar. 1, 2016

(54) HYBRID HANDLE TIE

(71) Applicant: EATON CORPORATION, Cleveland, OH (US)

(72) Inventors: Drew A. Reid, Brentwood, TN (US); Richard M. Elchik, Coraopolis, PA (US); Sandy Omar Jimenez, Monaca, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/578,781

(22) Filed: Dec. 22, 2014

(65) Prior Publication Data

US 2015/0107970 A1 Apr. 23, 2015

Related U.S. Application Data

(62) Division of application No. 13/477,328, filed on May 22, 2012, now Pat. No. 8,927,888.

(51) Int. Cl.

| | |
|---|---|
| ***H01H 1/20*** | (2006.01) |
| ***H01H 9/26*** | (2006.01) |
| ***H01H 71/10*** | (2006.01) |

(52) U.S. Cl.
CPC ..... *H01H 9/26* (2013.01); *H01H 71/1018* (2013.01); *H01H 2221/052* (2013.01)

(58) Field of Classification Search
CPC H01H 9/26; H01H 71/1018; H01H 2221/052
USPC ..... 200/50.32, 43.11, 50.11
See application file for complete search history.

(56) References Cited

U.S. PATENT DOCUMENTS

| | | | |
|---|---|---|---|
| 3,183,320 | A | 5/1965 | Darlow |
| 4,906,958 | A | 3/1990 | Adamson |
| 5,109,142 | A | 4/1992 | von Kannewurff et al. |
| 5,172,087 | A | 12/1992 | Castonguay et al. |
| 6,137,069 | A | 10/2000 | Casagrande et al. |
| 6,239,676 | B1 | 5/2001 | Maloney et al. |
| 6,239,962 | B1 | 5/2001 | Seymour et al. |
| 6,531,938 | B1 | 3/2003 | Smith et al. |
| 6,541,719 | B1 | 4/2003 | Powell |
| 7,342,474 | B2 | 3/2008 | Castonguay et al. |

*Primary Examiner* — Kyung Lee
(74) *Attorney, Agent, or Firm* — Eckert Seamans Cherin & Mellott, LLC; Philip E. Levy

(57) ABSTRACT

Apparatus are described herein that provide a circuit breaker handle tie configured to mechanically couple circuit breaker handles of different configurations to one another.

6 Claims, 3 Drawing Sheets

HYBRID HANDLE TIE

This application is a divisional of U.S. patent application Ser. No. 13/477,328, filed on May 22, 2012.

BACKGROUND

Wiring methods for buildings has evolved as design and construction codes become more complex and stringent in order to reduce energy consumption. One recent energy code standard with a purpose to reduce energy use while still maintaining occupant comfort is American Society of Heating Refrigeration and Air-Conditioning Engineers (ASHRAE) Standard 90.1. ASHRAE Standard 90.1 has become the standard for design and construction in the United States and has a strong influence on commercial building designs throughout the world. The 2010 revision to this standard includes a new requirement to reduce energy consumption by controlling plug load circuits.

SUMMARY

In one embodiment, a handle tie is provided that includes a connecting member, a first retaining member, and a second retaining member. The first retaining member is fixed to the connecting member and is configured to retain a first circuit breaker handle having a first configuration. The second retaining member is fixed to the connecting member and is configured to retain a second circuit breaker handle having a second configuration that is different from the first configuration.

In one embodiment, the first retaining member and the second retaining member are fixed to the connecting member in relative position such that the first retaining member aligns with a first circuit breaker handle and the second retaining member aligns with a second circuit breaker handle when corresponding first and second circuit breakers are installed in adjacent circuit breaker panel slots. In one embodiment, the first and second retaining members include first and second socket openings, respectively, configured to frictionally engage an outer periphery of the first and second circuit breaker handles, respectively, when the first and second circuit breaker handles are press fit into the first and second socket openings, respectively.

In one embodiment, the connecting member includes a plastic receiver base having a front face. The first retaining member includes a first socket molded into a rear portion of the retaining member base, where the first socket includes a first socket opening that extends through the front face, and further where the first socket opening has a periphery that corresponds to a periphery of the first circuit breaker handle. The second retaining member includes a second socket molded into a rear portion of the retaining member base. The second socket includes a second socket opening that extends through the front face and the second socket opening has a periphery that corresponds to a periphery of the second circuit breaker handle.

In one embodiment, the connecting member includes a linkage configured to span an offset distance between two adjacent circuit breakers with offset handles. The first retaining member includes a first rod projecting from a first distal end of the linkage that is configured to be coupled to a first circuit breaker handle. The second retaining member includes a first rod projecting from a second distal end of the linkage that is configured to be coupled to a second circuit breaker handle.

In one embodiment, an apparatus includes a first circuit breaker including a first handle operably coupled to a first pair of separable contacts. The first handle has a first handle configuration and is actuable to selectively open the first pair of separable contacts to interrupt the current flowing through the first circuit breaker. A second circuit breaker includes a second handle operably coupled to a second pair of separable contacts. The second handle has a second handle configuration different from the first handle configuration and is actuable to selectively open the second pair of separable contacts to interrupt the current flowing through the second circuit breaker. The first circuit breaker and the second circuit breaker are configured to be installed in adjacent circuit breaker panel slots. The apparatus also includes a handle tie configured to retain the first circuit breaker handle and the second circuit breaker handle in fixed mechanical relationship to one another. In this manner, actuation of one of the first and second circuit breaker handles will cause corresponding actuation of the other of the first and second circuit breaker handles.

In one embodiment, the first circuit breaker includes a controlled circuit breaker configured to input and output current generated by a first voltage phase. The controlled circuit breaker includes a control mechanism operably coupled to a third pair of separable contacts and configured to selectively open the third pair of separable contacts to interrupt the current generated by the first voltage phase in response to a control signal. The second circuit breaker includes an uncontrolled circuit breaker configured to input and output current generated by a second voltage phase that is different than the first voltage phase.

In one embodiment, the first circuit breaker and the second circuit breaker are configured to share a neutral conductor. In one embodiment, the first circuit breaker includes a first input connector configured to be electrically connected to a first conductor and the second circuit breaker includes a second input connector configured to be electrically connected to a second conductor. The first circuit breaker is mechanically connected to the second circuit breaker such that the first input connector and the second input connector are electrically isolated from one another.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. One of ordinary skill in the art will appreciate that in some embodiments one element may be designed as multiple elements or that multiple elements may be designed as one element. In some embodiments, an element shown as an internal component of another element may be implemented as an external component and vice versa. Furthermore, elements may not be drawn to scale.

DETAILED DESCRIPTION

Figure 1:
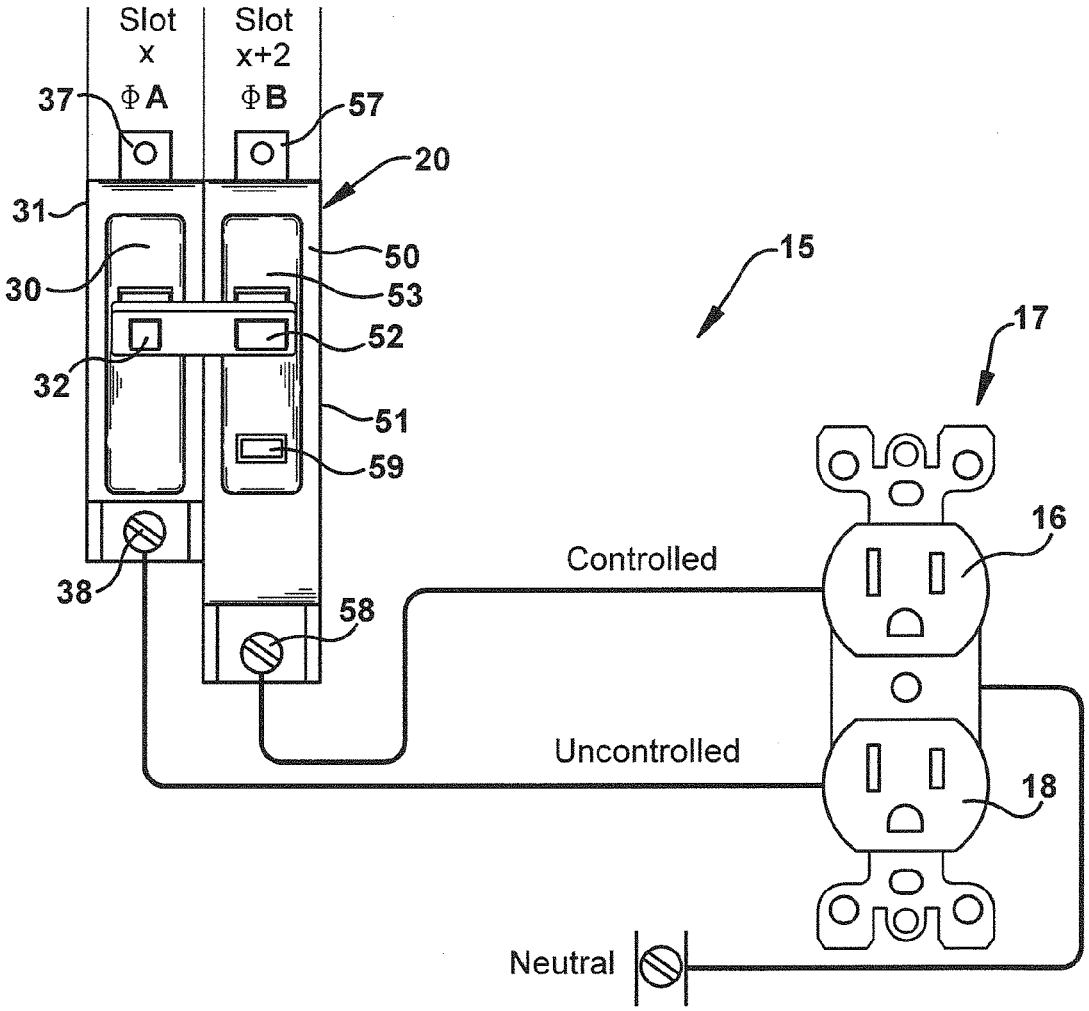
FIG. 1 is a schematic illustration of an electrical power circuit that includes one embodiment of a hybrid handle tie.

Energy codes set minimum requirements for energy-efficient design and construction for new and renovated buildings. Over the next few years switched receptacles will become law as energy codes are updated across the United States. Remote control circuit breaker systems provide a convenient method to meet this new requirement.

With every update of 90.1, ASHRAE sets a goal to improve energy savings over the previous version. With many improvements to lighting and HVAC efficiency already in place, miscellaneous electrical loads became an obvious target for additional energy savings. Non-essential plug loads are almost always left connected to receptacles when occupants are away. The "stand-by" power that these loads consume is a significant portion of energy consumption. The portion of energy consumption by non-essential plug loads will continue to rise as the efficiency of other systems improves. Controllable plug loads, such as task lights, printers, and computer monitors can be automatically "unplugged" by simply switching off the power supplied to the receptacle.

ASHRAE 90.1-2010 Section 8.4.2 stipulates automatic shut-off control of at least 50% of the receptacles installed in private offices, open offices and computer classrooms, including receptacles installed in modular partitions. Control options for shut-off include a time-of-day schedule, occupancy sensor, or by a signal from another system. This new requirement ensures that the controlled receptacle capability is provided in a building but allows flexibility in how it is used. At least one switched receptacle is to be provided near each uncontrolled receptacle. Occupants have the choice whether a load is plugged into a controlled receptacle. The occupant ultimately decides which loads are suitable for automatic shut-off without causing disruption to their business.

There are several ways that a building can be made to comply with Section 8.4.2. Switching of the controlled receptacle circuit can occur at either a remote controlled circuit breaker panel, a relay panel, or by an occupancy sensor located in the controlled area. The remote controlled circuit breaker panel is a versatile option. The remote controlled circuit breaker panel will already include an internal time clock for time-of-day control to meet the control requirement. Additionally, the remote controlled circuit breaker panel is capable of responding to external signals from occupancy sensors or other systems via a simple connection. As will be described in more detail below, installing uncontrolled (non-remote controlled) circuit breakers alongside remote controlled circuit breakers in the same remote controlled circuit breaker panel is one way to comply with Section 8.4.2.

Sharing a neutral conductor among several circuits is a common practice in commercial construction since it reduces the total number of wires, reduces voltage loss and heat, and reduces conduit fill. This practice is more likely with the new requirement to control receptacles since two circuits (e.g., uncontrolled and controlled) can supply a split duplex receptacle, two duplex receptacles in the same wall box, or even separated receptacles in the same area. It is a natural approach to wiring, especially when a centralized control system is used for switching a circuit. But particular attention needs to be paid to ensuring that controlled and uncontrolled receptacles follow electrical code requirements for multi-wire branch circuits when both do not originate from the same branch circuit.

A potentially non-compliant situation exists when receptacles supplied from different circuits on the same phase share a neutral conductor. The current through the neutral conductor is the total supplied by the two circuits, potentially exceeding the rating. Although the neutral conductor could be an appropriately sized larger gauge of wire, a second problem remains when the circuit is serviced if both branches are not disconnected. It is not possible to link the two branch breakers with a handle tie to create a simultaneous disconnect means since same phases are not adjacent in the circuit breaker panel. Keeping the two circuits separate by using individual neutral wires and locating the receptacles in different wall boxes would avoid these hazards.

When a remote controlled circuit breaker and an uncontrolled circuit breaker are installed in adjacent slots in a circuit breaker panel, input connections for the remote controlled circuit breaker and the uncontrolled circuit breaker are separate from one another. When installed in a panel, the remote controlled circuit then controls a branch circuit on a first phase and the uncontrolled circuit breaker controls a branch circuit on a second phase. Described herein are various embodiments of a hybrid handle tie that is configured to connect handles of two circuit breakers having dissimilar handle configurations. For example, the hybrid handle ties described herein may be used to connect a handle of a remote controlled circuit breaker to a handle of a uncontrolled circuit breaker when the handles of the two types of circuit breakers do not have the same configuration.

FIG. 1 shows an electrical circuit 15 that includes a circuit breaker pair 20 that includes two circuit breakers. (Only two phases are shown for clarity.) The circuit breakers in the circuit breaker pair 20 are residential and commercial lighting and appliance branch circuit breakers of the narrow width type. Such circuit breakers provide overload current protection and may also provide controlled current interruption in response to a control signal. The two most common widths for such circuit breakers are three-quarters inch, and one inch. The circuit breakers typically have a height of three and one-quarter inches, and a length of four inches. The dimensions given correspond to the outside dimensions of the circuit breaker's molded case.

The circuit breaker pair 20 includes an uncontrolled circuit breaker 30. For the purposes of this description, an uncontrolled circuit breaker is a circuit breaker that is not equipped to disconnect power in response to a control signal (e.g., timer, occupancy sensor). An uncontrolled circuit breaker is configured to disconnect power in response to an overload event. The uncontrolled circuit breaker 30 includes a handle 32 that allows a user to manually operate the circuit breaker. The handle 32 has a generally square shape.

Figure 2:
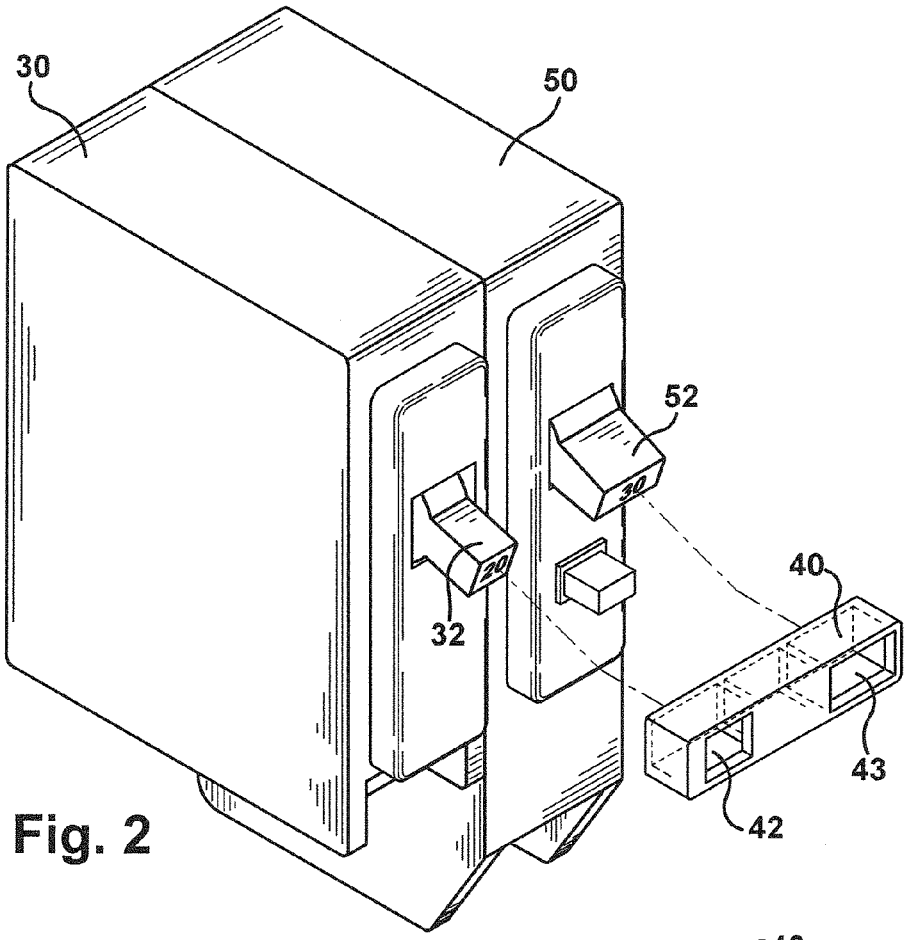
FIG. 2 is a perspective view of one embodiment of a hybrid tie uninstalled from a circuit breaker pair.

The circuit breaker pair 20 includes a controlled circuit breaker 50. For the purposes of this description, a controlled circuit breaker is a circuit breaker that is equipped to disconnect power in response to a control signal. Controlled circuit breakers may be called "remote controlled" circuit breakers in some contexts. The controlled circuit breaker 50 may also sometimes be distinguished by an override handle 59 (FIG. 2). The override handle can be used to manually close remotely controlled contacts in the controlled circuit breaker 50. The position of the override handle 59 indicates a status of the controlled contacts in the circuit breaker 50. For example, when remotely controlled contacts are closed, a red region may be visible. The red region may be covered by the override handle when the remotely controlled contacts are open. The controlled circuit breaker 50 also includes a handle 52 that allows a user to manually open and close contacts in the circuit breaker that are responsive to trip events. The handle 52 has a generally rectangular shape. Example controlled circuit breakers are described in U.S. Pat. Nos. 5,301,083 and 6,888,431, both of which are incorporated herein by reference in their entirety.

Both the controlled branch circuit and the uncontrolled branch circuit share a neutral conductor. A hybrid handle tie 40 mechanically couples the handle 32 to the handle 52. This connection between the handles of two circuit breakers is required by some electrical codes when circuits controlled by the two breakers share a neutral. The hybrid handle tie 40 is capable of mechanically coupling the square handle 32 to the rectangular handle 52.

The circuit breaker pair 20 is installed in adjacent slots x and x+2 in a circuit breaker panel (panel not shown). By convention, adjacent slots in a circuit breaker panel (e.g., slot x and slot x+2) are connected to different phases. An input connector 37 of the uncontrolled circuit breaker 30 is installed in slot x and an input connector 57 of the controlled circuit breaker 50 is installed in slot x+2. The input connector 37 and the input connector 57 are electrically separate or isolated so that different phases are input to the uncontrolled circuit breaker 30 and the controlled circuit breaker 50 when the circuit breaker pair 20 is installed in a panel. The uncontrolled circuit breaker 30 is connected, by way of connection fastener 38, in a branch circuit on phase A. The controlled circuit breaker 50 is connected, by way of connection fastener 58, in a branch circuit on phase B. In the electrical circuit 15, a duplex outlet 17 is provided that includes a controlled outlet 16 connected to phase B and an uncontrolled outlet 18 connected to phase A.

In the circuit shown in FIG. 1, the cancellation effect of the phases actually reduces the current flowing through the neutral conductor, reducing it all the way to zero when the current flowing through each branch is equal. The branch circuit breakers are linked with a hybrid handle tie 40 (as shown) to assure that power is removed simultaneously. The simultaneous disconnect feature prevents back-feed from the shared circuit that could possibly damage equipment should the neutral be disconnected from the panel. FIG. 2 illustrates the hybrid handle tie 40 uninstalled from the circuit breaker pair 20. The hybrid handle tie 40 includes a first receiver 42 that can be press fit onto the handle 32 and a second receiver 43 that can be press fit onto the handle 52.

Figure 3:
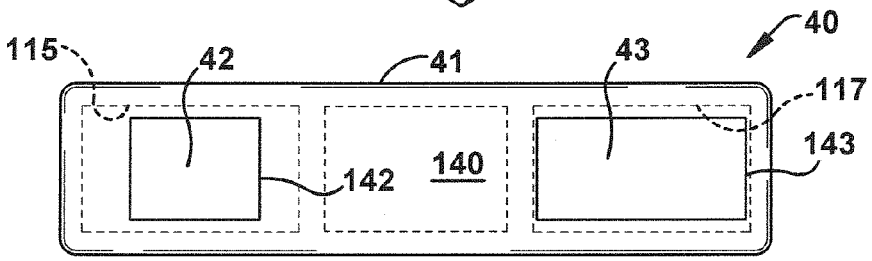
FIG. 3 is a front view of the hybrid handle tie of FIG. 2.

FIG. 3 shows a front view of one embodiment of a hybrid handle tie 40. The hybrid handle tie 40 includes a connecting member or base 41 and two retaining members (e.g., receivers 42, 43) configured to engage circuit breaker handles. The base 41 includes a front face 140. The first receiver 42 is located near one end of the base 41. The first receiver includes a first socket opening 142 that extends through the front face 140 and is configured to retain a first circuit breaker handle having a square shape (e.g., the handle 32 in FIGS. 1 and 2). The second receiver 43 is located near the other end of the base 41. The second receiver 43 includes a second socket opening 143 that extends through the front face 140 and is configured to retain a second circuit breaker handle having a rectangular shape that is different from the square shape retained by the first receiver (e.g., the handle 52 in FIGS. 1 and 2). While a square shaped socket opening 142 and a rectangular shaped socket opening 143 are shown, any number of different shaped socket openings may be employed to retain pairs of circuit breaker handles of different shapes, (e.g., circular, blade, and so on).

The first receiver 42 and the second receiver 43 are fixed in relative position such that the first receiver 42 aligns with a first circuit breaker handle (e.g., handle 32) and the second receiver 43 aligns with a second circuit breaker handle (e.g., handle 52) when the corresponding first and second circuit breakers are installed in adjacent circuit breaker panel slots.

Figure 4:
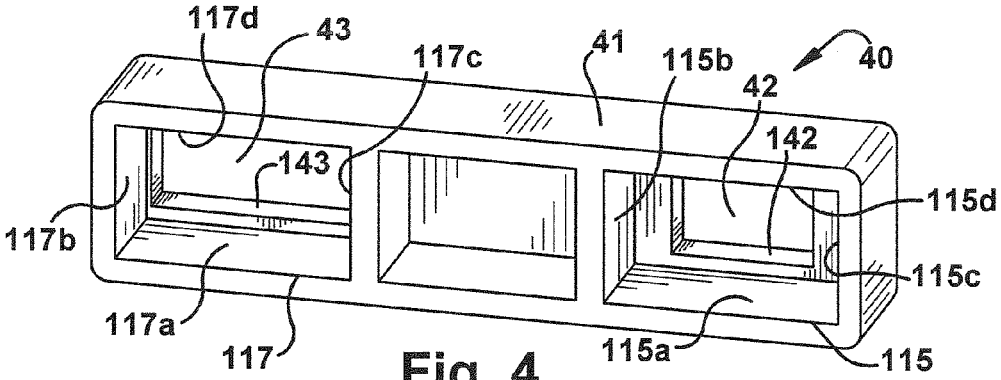
FIG. 4 is a perspective view of the hybrid handle tie of FIG. 2.

FIG. 4 is a rear perspective view of the hybrid handle tie 140. The hybrid handle tie 40 includes first and second sockets 115, 117, respectively, formed behind the front face 140. The first socket 115 is defined by socket walls 115*a*-115*d*. The first socket 115 includes the first socket opening 142 that is configured to frictionally engage an outer periphery of the first circuit breaker handle (e.g., square handle 32). The second socket 117 is defined by socket walls 117*a*-117*d*. The second socket 117 includes the second socket opening 143 that is configured to frictionally engage an outer periphery of the second circuit breaker handle (e.g., rectangular handle 52). While the first socket 115 and the second socket 117 are shown as having the same dimensions, the first socket 115 and second socket 117 may have different dimensions, as long as sufficient clearance is provided for the circuit breaker handles to be installed in the hybrid handle tie 40.

Figure 5:
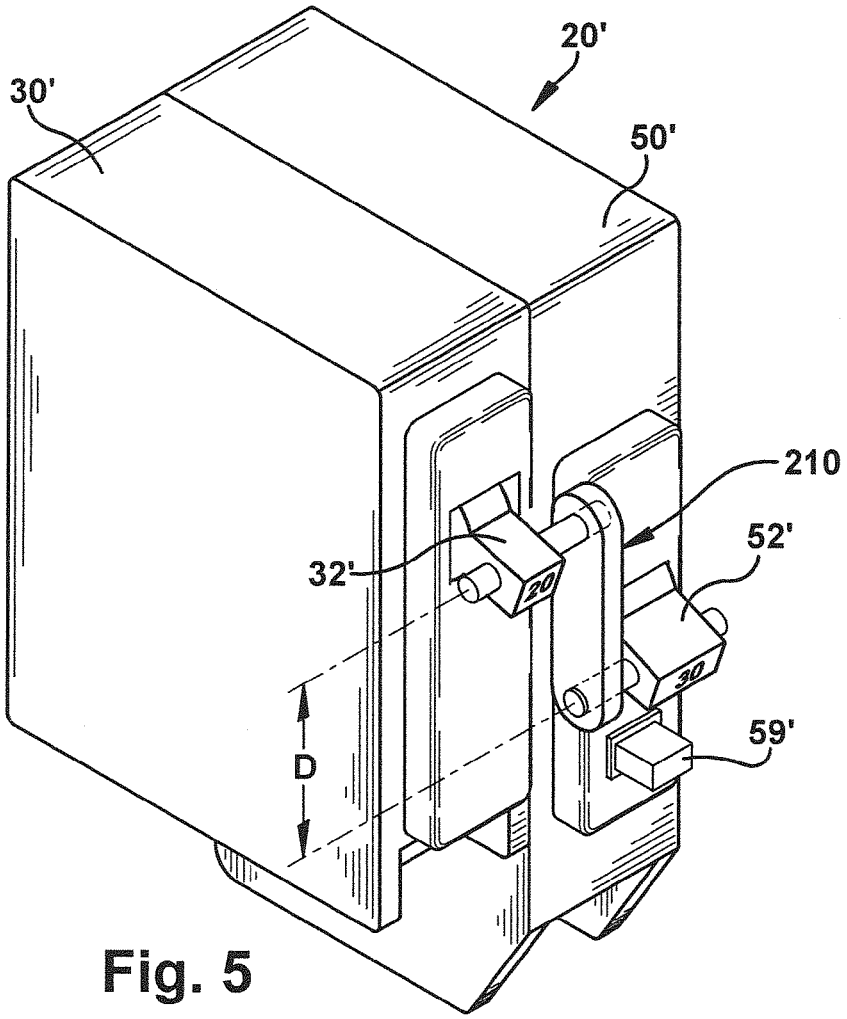
FIG. 5 is a perspective view of a circuit breaker pair that includes an alternative embodiment of a hybrid handle tie.
Figure 6:
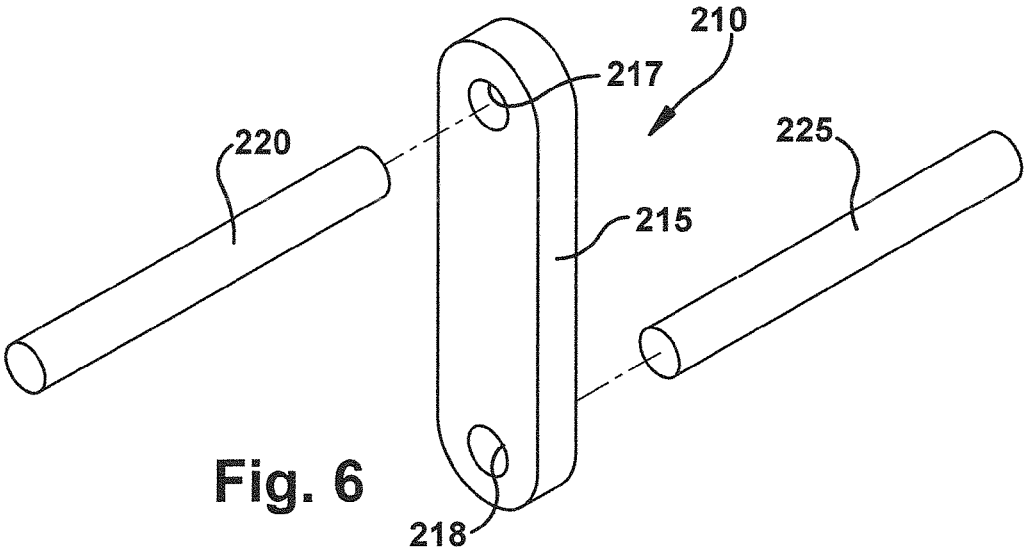
FIG. 6 is an exploded view of the hybrid handle tie of FIG. 5.

FIGS. 5 and 6 illustrate an alternative embodiment of a hybrid handle tie 210. FIG. 5 shows a circuit breaker pair 20' that includes an uncontrolled circuit breaker 30' with a handle 32'. The circuit breaker pair 20' also includes a remote controlled circuit breaker 50' with a handle 52'. The handles 32' and 52' are not vertically aligned with one another. The handles 32' and 52' are offset from one another by an offset distance D. A hybrid handle tie 210 is configured to couple the handles 32' and 52' together so that when one handle is actuated by a user, the other handle is actuated as well. The hybrid handle tie 210 spans the offset distance D and is connected to the handles 32', 52' at opposite distal ends.

FIG. 6 is an exploded view of the hybrid handle tie 210. The hybrid handle tie 210 includes a linkage 215 that has holes 217, 218 at first and second distal ends, respectively, of the linkage 215. A first rod 220 is pressed into the first hole 217 and a second rod 225 is pressed into the second hole 218. The rods 220, 225 are configured to be inserted into holes in the circuit breaker handles 32', 52'. In one embodiment, the rods 220, 225 are sized so that they may rotate within the holes in the handles 32', 52' when the handles are moved. One or both of the rods may be pressed into the holes 217, 218 after being installed in the handles. While the rods 220, 225 are shown as being inserted into holes in the handles, other methods of coupling the handles 32', 52' to the linkage 215 may be employed (e.g., clips, adhesives, and so on).

While for purposes of simplicity of explanation, the illustrated methodologies in the figures are shown and described as a series of blocks, it is to be appreciated that the methodologies are not limited by the order of the blocks, as some blocks can occur in different orders and/or concurrently with other blocks from that shown and described. Moreover, less than all the illustrated blocks may be used to implement an example methodology. Blocks may be combined or separated into multiple components. Furthermore, additional and/or alternative methodologies can employ additional blocks that are not illustrated.

References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

While example systems, methods, and so on have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosure is not limited to the specific details, the representative apparatus, and illustrative examples shown and described. Thus, this application is intended to embrace alterations, modifications, and variations that fall within the scope of the appended claims.

To the extent that the term "includes" or "including" is employed in the detailed description or the claims, it is intended to be inclusive in a manner similar to the term "comprising" as that term is interpreted when employed as a transitional word in a claim.

To the extent that the term "or" is used in the detailed description or claims (e.g., A or B) it is intended to mean "A or B or both". When the applicants intend to indicate "only A or B but not both" then the phrase "only A or B but not both" will be used. Thus, use of the term "or" herein is the inclusive, and not the exclusive use. See, Bryan A. Garner, A Dictionary of Modern Legal Usage 624 (2d. Ed. 1995).

To the extent that the phrase "one or more of, A, B, and C" is used herein, (e.g., a data store configured to store one or more of, A, B, and C) it is intended to convey the set of possibilities A, B, C, AB, AC, BC, and/or ABC (e.g., the data store may store only A, only B, only C, A&B, A&C, B&C, and/or A&B&C). It is not intended to require one of A, one of B, and one of C. When the applicants intend to indicate "at least one of A, at least one of B, and at least one of C", then the phrasing "at least one of A, at least one of B, and at least one of C" will be used.

What is claimed is:

1. A handle tie, comprising:

a connecting member;

a first retaining member fixed to the connecting member, where the first retaining member is configured to retain a first circuit breaker handle having a first configuration; and a second retaining member fixed to the connecting member, where the second retaining member is configured to retain a second circuit breaker handle having a second configuration that is different from the first configuration;

wherein the connecting member comprises a linkage configured to span an offset distance between two adjacent circuit breakers with offset handles;

the first retaining member comprises a first rod projecting from a first distal end of the linkage, the first rod configured to be coupled to a first circuit breaker handle; and the second retaining member comprises a first rod projecting from a second distal end of the linkage, the second rod configured to be coupled to a second circuit breaker handle.

2. The handle tie of claim 1 where the first retaining member and the second retaining member are fixed to the connecting member in relative position such that the first retaining member aligns with a first circuit breaker handle and the second retaining member aligns with a second circuit breaker handle when corresponding first and second circuit breakers are installed in adjacent circuit breaker panel slots.

3. An apparatus, comprising:

a first circuit breaker comprising a first handle operably coupled to a first pair of separable contacts, the first handle having a first handle configuration and actuable to selectively open the first pair of separable contacts to interrupt the current flowing through the first circuit breaker;

a second circuit breaker comprising a second handle operably coupled to a second pair of separable contacts, the second handle having a second handle configuration different from the first handle configuration, the second handle actuable to selectively open the second pair of separable contacts to interrupt the current flowing through the second circuit breaker;

where the first circuit breaker and the second circuit breaker are configured to be installed in adjacent circuit breaker panel slots; and a handle tie configured to retain the first circuit breaker handle and the second circuit breaker handle in fixed mechanical relationship to one another, such that actuation of one of the first and second circuit breaker handles will cause corresponding actuation of the other of the first and second circuit breaker handles;

wherein the handle tie comprises a first retaining member and a second retaining member fixed to a connecting member in relative position such that the first retaining member aligns with the first circuit breaker handle and the second retaining member aligns with the second circuit breaker handle when corresponding first and second circuit breakers are installed in adjacent circuit breaker panel slots;

wherein the first and second handles are offset from one another by an offset distance;

wherein the connecting member comprises a linkage configured to span the offset distance;

wherein the first retaining member comprises a first rod projecting from a first distal end of the linkage, the first rod configured to be coupled to a first circuit breaker handle; and wherein the second retaining member comprises a first rod projecting from a second distal end of the linkage, the second rod configured to be coupled to a second circuit breaker handle.

4. The apparatus of claim 3 where:

the first circuit breaker comprises a controlled circuit breaker configured to input and output current generated by a first voltage phase, and further comprising a control mechanism operably coupled to a third pair of separable contacts and configured to selectively open the third pair of separable contacts to interrupt the current generated by the first voltage phase in response to a control signal; and the second circuit breaker comprises an uncontrolled circuit breaker configured to input and output current generated by a second voltage phase that is different than the first voltage phase.

5. The apparatus of claim 3 where the first circuit breaker and the second circuit breaker are configured to share a neutral conductor.

6. The apparatus of claim 3 where:

the first circuit breaker comprises a first input connector configured to be electrically connected to a first conductor;

the second circuit breaker comprises a second input connector configured to be electrically connected to a second conductor; and where the first circuit breaker is mechanically connected to the second circuit breaker such that the first input connector and the second input connector are electrically isolated from one another.

* * * * *